United States Patent [19]

Bartlett et al.

[11] 4,254,644

[45] Mar. 10, 1981

[54] APPLICATION OF LIQUID IN MULTIPLE STREAMS TO A MOVING STRIP

[75] Inventors: Ian G. Bartlett, Belmont; Arthur D. Barron, Geelong West; Donald A. Lymer, Highton, all of Australia; George A. R. McKendrick, Port Vila, New Hebrides

[73] Assignee: Tybar Engineering Pty. Ltd., Victoria, Australia

[21] Appl. No.: 42,501

[22] Filed: May 25, 1979

[30] Foreign Application Priority Data

| | | | |
|---|---|---|---|
| May 29, 1978 | [AU] | Australia | PD4538 |
| May 29, 1978 | [AU] | Australia | PD4539 |
| May 29, 1978 | [AU] | Australia | PD4540 |
| Sep. 25, 1978 | [AU] | Australia | PD6106 |

[51] Int. Cl.[3] ..... D06B 1/02

[52] U.S. Cl. ..... 68/205 R; 137/561 A; 137/861; 239/562; 239/589

[58] Field of Search ..... 68/205 R; 118/313, 314; 137/861; 239/551, 562

[56] References Cited

U.S. PATENT DOCUMENTS

| | | | |
|---|---|---|---|
| 2,218,811 | 10/1940 | Chaussabel | 68/205 R X |
| 3,688,530 | 9/1972 | Harris et al. | 68/205 R |
| 4,005,590 | 2/1977 | McLean | 68/205 R X |
| 4,111,012 | 9/1978 | O'Neill, Jr. | 68/205 R |

*Primary Examiner*—Philip R. Coe

*Attorney, Agent, or Firm*—O'Brien & Marks

[57] ABSTRACT

Apparatus for applying liquid to a moving strip includes a conveyor, a reservoir for the liquid, an array of multiple nozzles arranged above and transversely of the conveyor, and multiple remote controllable valves actuable by a programmable electronic control to cause respective streams of liquid received from said reservoir to issue from the nozzles onto the strip in accordance with a predetermined pattern. A multiplicity of fluid distributors are provided between the valves and the nozzles so that one or more repeats of the pattern occur across the strip. The lengths of the fluid lines connecting the nozzles of each group to its distributor are substantially equal. Novel fluid distributor construction are also disclosed.

11 Claims, 12 Drawing Figures

APPLICATION OF LIQUID IN MULTIPLE STREAMS TO A MOVING STRIP

This invention relates broadly to the application of liquid to a moving strip and is concerned more particularly, though not exclusively, with an improved process and apparatus having special utility in the dyeing of carpet or like pile material. Such material may be treated as a continuous strip or as a discontinuous strip as would be necessary in the case of carpet tiles.

Recent years have seen the development of a number of carpet printing techniques based on the principle of selectively applying a multiplicity of streams of dye liquor to a passing web of carpet in such a manner as to produce a sharply defined pattern having a uniformly reliable colour distribution. A suitable electronic control for the dye streams may be programmed to trigger the sequence of application of the dye streams required to reproduce any desired pattern.

Australian Pat. No. 488714 is one of a series which together describe a technique of the above kind in which continuously issuing dye streams are normally deflected by air jets into an adjacent trough for recirculation. Impingement of a dye stream onto an underlying web or pile of carpet is effected by closing the individual valve controlling the associated air jet to allow the dye stream to be directed on to the carpet without deflection. This technique suffers from an inherent degree of aeration in the recycling dye which is not wholly eliminated by the provision made for separating the dye and air streams within the dye collection trough and which causes random variations of flow rate.

An alternative carpet printing technique of the type in which dye stream impingement is effected by temporary withdrawal of normal deflection of the continuously issuing dye streams, is described, for example, in British Pat. No. 1202345. Here a respective extending finger physically diverts each stream to a trough but is capable of flexure when required to allow forward movement of the stream onto the passing carpet.

U.S. Pat. No. 3,393,411 discloses an arrangement in which control of each dye stream is by way of a solenoid or pinch valve in the feed tube leading to the respective nozzle. Quick response at the nozzle is achieved by the retention of fluid by capillary action in the tube between the valve and the nozzle orifice when the valve is closed. In this context, and in the context of the present specification, the term "nozzle" embraces a mere outlet orifice from a liquid manifold or supply duct.

Direct supply of dye liquor from the feed tubes onto the underlying moving strip is also described in U.S. Pat. No. 2,218,811 in connection with the dyeing of fabrics. Here, a line of nozzles is fed from a plurality of dye tanks via simple hand valves and distributor pipes associated with each tank. The present invention stems from the realization that distributors can also be used to novel advantage with remote controllable valves, such as those employed in the air jet deflection technique already referred to, and that especially suitable distributors can be designed for this purpose.

The present invention provides, in one aspect, apparatus for applying liquid to a moving strip comprising conveyor means for guiding said strip past an application station, means for providing a reservoir of the liquid, an array of multiple openings arranged above and transversely of the conveyor means at or adjacent said application station, and, disposed in fluid flow lines between the reservoir and said openings, multiple remote controllable valve means selectively actuable by a programmable electronic control to cause respective streams of liquid received from said reservoir to issue from the openings onto said strip at the application station in accordance with a predetermined pattern of application of the liquid to the strip wherein there is further provided a multiplicity of fluid distributors in said fluid flow lines between the valve means and said openings whereby each valve means controls liquid issue from a respective group of associated openings so arranged in relation, to the other groups that one or more repeats of said pattern occur across said strip, and wherein the lengths of the fluid lines connecting the openings of each group to its distributor are substantially equal.

A process in accordance with the invention comprises guiding the strip past an application station and applying the liquid to the strip at the application station by way of a multiplicity of streams of the liquid, which streams are selectively controlled by programmable electronic control to reproduce a desired pattern of application on the carpet, wherein respective sets of the streams spaced across the carpet are each jointly controlled as a common flow prior to distribution into the individual streams which sets are so arranged relative to each other than that one or more repeats of said pattern occur across said strip.

In a preferred arrangement, individual flexible tubes convey the liquid from the fluid distributors to the openings in the form of nozzles, the tubes associated with each distributor being of equal length. The flow paths from a given distributor should be substantially equal to ensure equal flow rates and thus uniformity of pattern shade between repeats. These tubes are preferably so dimensioned in relation to the physical characteristics of the liquid that, on closing of a respective valve, liquid immediately ceases to flow from the associated nozzles and is retained as a cohesive stream between the valve and nozzles by capillary action. In this manner, rapid response to valve command is achieved at the nozzles despite their relative remoteness from the valves. It is preferred in applying the process of the invention, which assumes dye stream uniformity, that the distributors do not entrap air when liquid is initially permeated through the flow circuitry. Such air pockets may break the aforementioned capillary action and thereby introduce a dye application fault. It is therefore a further object of the invention to provide an improved distributor suitable for use in airless continuous fluid flow circuits. More specifically, the invention provides, in a second aspect, a fluid distributor comprising an inlet port to a holding cavity and a plurality of outlet ports from the cavity, the outlet ports being substantially opposed to the inlet port and being formed in a wall portion or portions which are concave to said cavity.

Preferably, the said cavity is defined in part by a cylindrical wall and the outlet ports and spaced about an annular channel which forms an extension of the cavity and is determined by a surface smoothly and continuously curved transversely of the channel.

The invention further provides a fluid distributor comprising:

a body;

an inlet port to a holding cavity within the body, and a plurality of outlet ports from the cavity; and plunger means actuable to close off one of the outlet ports;

wherein the plunger means extends into a control fluid duct passing through the distributor body and is arranged to be actuable as aforesaid by a predetermined fluid pressure in the duct. Also afforded by the invention is an arrangement of such distributors wherein the respective control fluid ducts of the distributors are connected in series. Advantageously, the distributor bodies are arranged in linear array in abutting relationship with the said fluid flow duct of each distributor body communicating directly with the duct of the adjacent body or bodies.

This arrangement affords a technique for achieving rapid switching of the plungers of a very large number of distributors. In a typical apparatus for the dyeing of broadloom carpet, in accord with the invention, there may be of the order of 1000 nozzles requiring preferably about 250 distributors. These distributors are desirably laid out so that the large number of tubes communicating them to their respective sets of nozzles are arranged in a manner which optimises ease of installation and access for maintenance while ensuring that the lines are substantially of equal length for uniform nozzle response and, accordingly, reliable pattern control. With this in mind, the multiplicity of distributors are preferably arranged on a distributor board on successive arcs of a radius which increases in approximate correspondence to the successive relative displacement of the associated nozzles.

The invention will now be further described by way of example only with reference to the accompanying drawings, in which.

Figure 1:
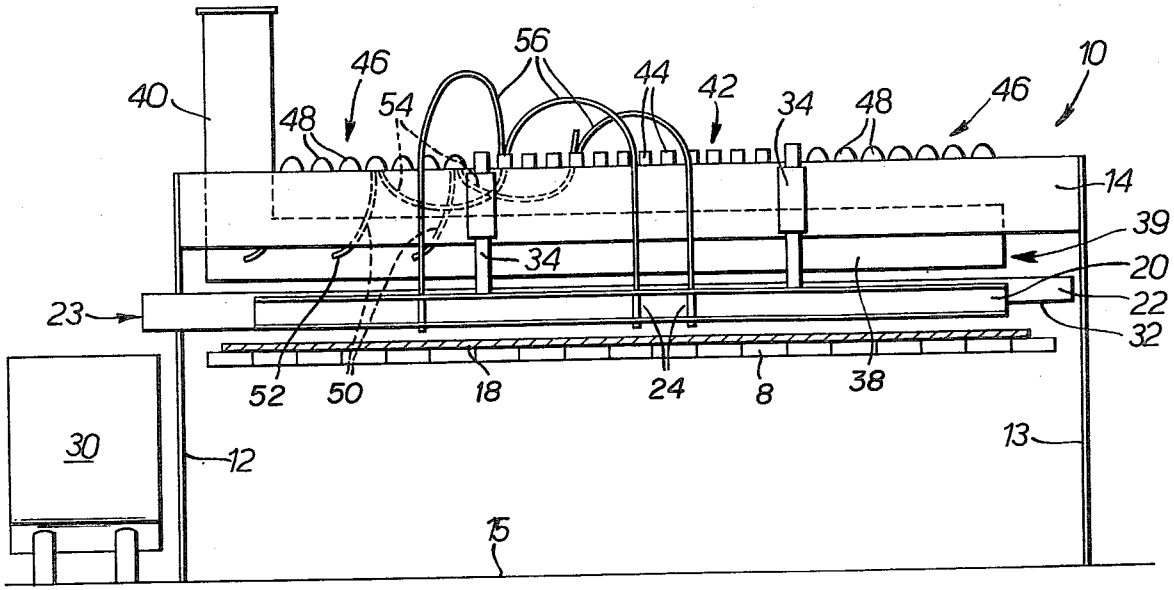
FIG. 1 is a somewhat schematic front elevational view of a dye applicator unit constructed as an apparatus in accordance with the invention and intended for printing a continuous web of broadloom carpet.
Figure 12:
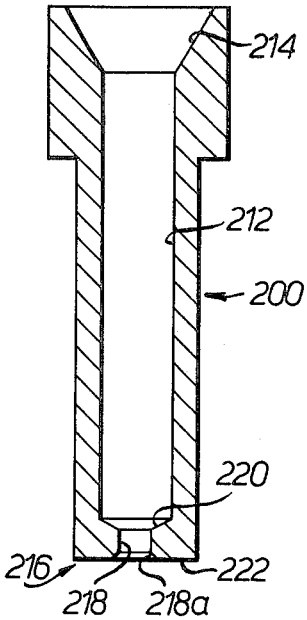
Figure 9:
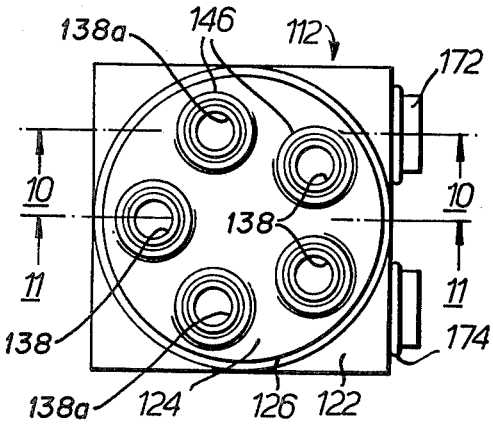
FIG. 9 is a plan view of the centre distributor shown in FIG. 8.
Figure 10:
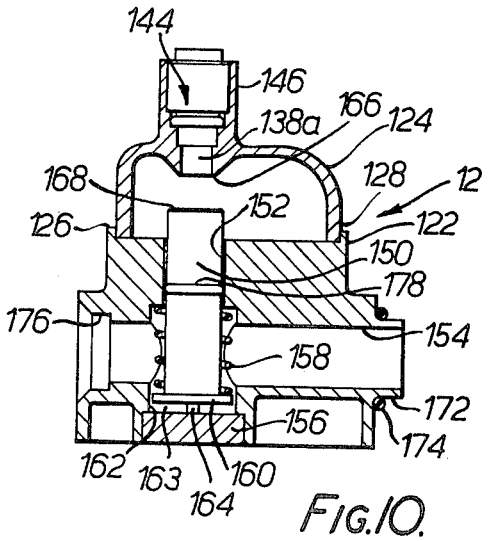
Figure 11:
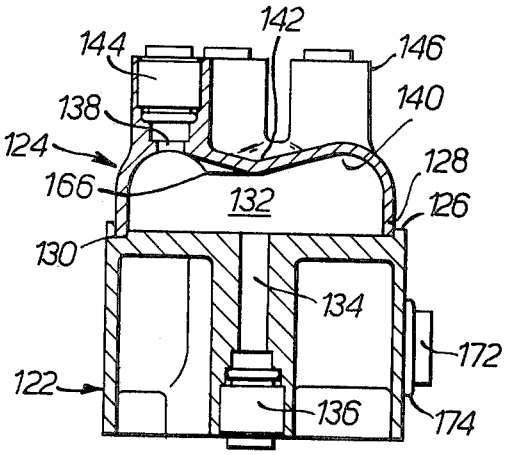

FIGS. 10 and 11 are respective cross-sections on the lines 10—10 and 11—11 in FIG. 9; and FIG. 12 depicts in axial cross-section one of the nozzles forming part of the unit of FIG. 1.

The illustrated applicator unit would typically be one of a series of substantially identical units arranged in close succession along and about a carpet conveyence line, each unit being arranged to apply dye of a respective uniform colour to the carpet. The dye applicator unit is intended to process broadloom carpet which is drawn along the treatment line in a substantially continuous strip of, say, several hundred feet. The unit is set up for standard 12 ft carpet, but arrangements for selectively varying the dyed width are discussed subsequently.

Prior to its presentation to the printing stations defined by the applicator units, the moving carpet strip will have been fed from a J-bin accummulator through a vacuum suction lint extractor. A base colour or other primary liquid may have been applied in a pad dyeing unit. After application of the successive dye colours to reproduce the required pattern (in the manner to be outlined) the carpet is subjected to the appropriate treatment for fixing the dye stuff on the carpet. This treatment may entail enclosure of the carpet in a steaming chamber and will typically be followed by a washing step to remove material which has not been fixed by the steaming process, including dye stuff and other components of the dye liquor which one does not desire or require to remain in the finished garment. The spray, and entrained matter, are removed by way of a vacuum extractor.

Figure 2:
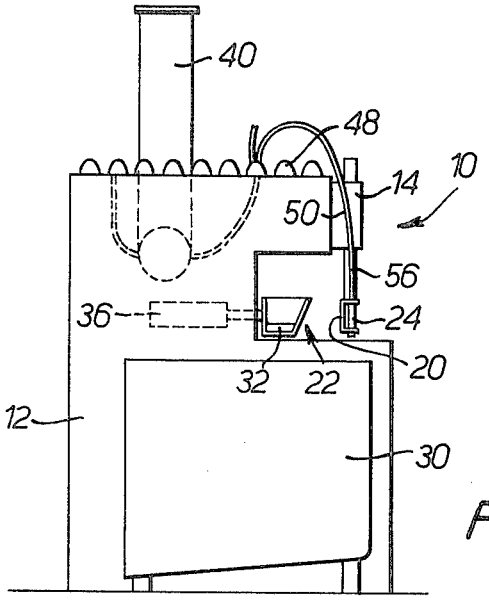
FIG. 2 is a side elevational view of the unit of FIG. 1 and, like FIG. 1 shows the unit in a printing mode.

Referring now to FIGS. 1 and 2, each dye applicator unit 10 includes upright side structural members 12, 13 interconnected by horizontal structural members such as the front facia panel indicated at 14. These members together form a frame work fixed to the floor 15 and straddling the conveyor along which the web of carpet is moved in a horizontal disposition. The the conveyor is not detailed in the drawings but its upper run is depicted at 8 in FIG. 1 and the position of the passing carpet is indicated at 18. If desired, the carpet may move in a plane inclined to the horizontal.

The two primary movable parts of the unit requiring relative adjustment of their positions to convert the unit from a dye application condition to a non application condition are a nozzle board 20 and a dye collection trough 22. Nozzle board 20 is of open-fronted channel form and mounts an array of nozzles 24, detailed subsequently, which are arranged in two staggered lines to emit dye streams at uniform ⅛th" intervals across the carpet. It will be seen that for a 12 ft broadloom carpet, 1,152 nozzles will be required. Dye collection trough 22 is transversely longer than the nozzle board and is open at one end 23, for release of collected dye into an open top tank 30 at the side of the unit. The floor 32 of the trough is gently sloped across the unit from this opening to allow steady flow of the dye to the opening.

Nozzle board 20 is reciprocable vertically by a pair of hydraulic or pneumatic rams 34 while trough 22 is reciprocable horizontally by one or more like rams 36. For the print mode (FIG. 2), the trough is withdrawn and the nozzle board is brought down to present the nozzles immediately above the pile of the passing carpet. When not printing but with the unit on standby, (FIG. 3), trough 22 is brought forward to a position to accept the dye streams 9 for recirculation via tank 30. To minimise splashing, and the consequent risk of air entrainment in the streams, the forward interior face of the trough is slanted for smooth impingement of the dye streams.

Other mechanisms may of course be employed for moving the nozzle board and trough. For example, the nozzle board may be raised and lowered by means of a horizontally disposed ram acting through coupled crank elements having toothed gear segments for meshing with toothed segments on upright posts supporting the nozzle board.

Dye liquor is accumulated for dispersal to the nozzles in a horizontally extending cylindrical manifold 38 closed at one end, 39, but contiguous at the other with a hollow column 40 which extends well above the top of the unit to determine the required pressure head for the liquor in the manifold. Arranged uppermost on the unit is an array 42 of distributors 44, detailed subsequently, and, to either side of this array, further arrays 46 of solenoid actuated valves or regulators 48. Each array is set on a respective distributor or valve board which extends rearwardly from the top edge of facia member 14.

Each valve 48 receives dye liquor from manifold 38 by way of an individual flexible tube 50, which opens into the manifold at a respective orifice 52. If open, the valve passes the liquor, by way of a further flexible tube 54, to a respective distributor 44 from where the liquor is uniformly distributed per four individual flexible tubes 56 of equal length to corresponding nozzles of four equal sections of the nozzle array, thus ensuring three pattern repeats across the carpet. For Example, counting from the left in FIG. 1, and taking the previously exemplified nozzle number of 1152, each successive nozzle section will have 288 nozzles. A first distributor, which might be designated distributor 1, will pass liquor to the leftmost nozzle of each section, that is to nozzles 1,289,577 and 865, the second distributor, No. 2, to nozzles 2,290,578 and 866 and so on.

The various flexible tubes 50, 54 and 56, only a few of which are shown in the drawings, are so dimensioned in relation to the physical characteristics of the dye liquor that on closing of a respective valve, dye liquor immediately ceases to flow from the associated nozzles and is retained as a cohesive stream between the valve and nozzles by capillary action. In this manner, rapid response to valve command is achieved at the nozzles despite their relative remoteness from the valves.

In operation for dye printing a passing web of carpet, the solenoid valves 48 are triggered in and out from an electronic control unit 45 (FIG. 4) on the basis of detailed programmed instructions for producing a required pattern on the carpet. The manner in which the programme is developed and utilised is known and will not be described in further detail. The rate at which the pattern is being reproduced at any given time is determined by the instanteous speed of travel of the carpet. This is achieved by providing for the moving carpet to clock the cycling of pattern data to the valve control module. Where a number of dye applicator units are employed in succession for depositing different colours to make up a complete pattern the spacing of the units requires that the data for the respective parts of the pattern be delayed by an appropriate number of clock counts. Small adjustments to this set number of counts can be made by indexing a line of data at a time to bring the pattern into correct synchronization.

Figure 4:
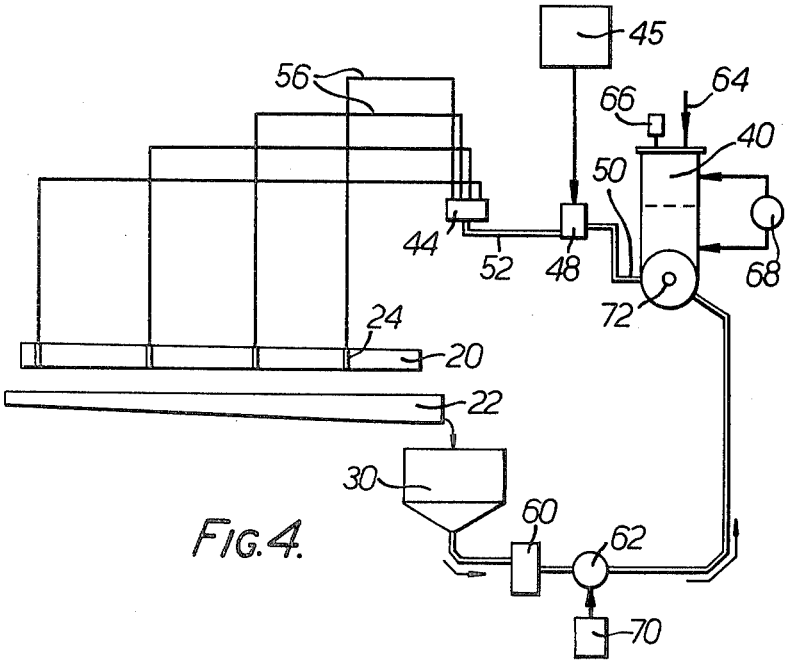
FIG. 4 is a dye flow circuit diagram for a representative valve/distributor pair in the unit of FIGS. 1 to 3.
Figure 3:
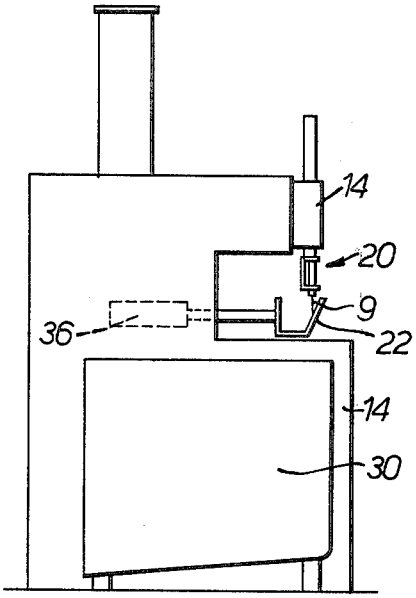
FIG. 3 is a side elevational view corresponding to FIG. 2 but showing the unit in an operational but non printing mode.

FIG. 4 is a dye flow diagram for one distributor/-valve pair of the unit of FIGS. 1 to 3. Between carpet printing operaions it is desirable to continuously cycle the dye liquor to rid the circuit of any air pockets and thereby optimise accurate and reliable response to the operation of the valves 48, a response which is presumed to be predictable in the preparation of pattern programmes for the valve control module. In this condition of the unit, as already foreshadowed, the nozzle board is raised and the dye collection trough brought forward to the position shown in FIG. 3 in which it collects the dye liquor continuously issuing from all of the nozzles 24. The collected dye passes to the side tank 30, thence by way of a filter 60 and pump 62 to the manifold 38. At this stage, groups of the solenoid valves 48 are in turn opened and accordingly dye continuously recycles from manifold through the valves and distributors back to the nozzles 24.

Pressure column 40 includes a pressure regulated air intake 64 and a preset pressure release valve 66. A level controller 68 responsive to pressure of the liquor in the column is coupled to determine the condition of a variable speed motor 70 which operates the pump 62. When it is desired to thoroughly clean out the dye liquor circuit, such in preparation for a change of colour, the manifold and nozzles are drained and the manifold thoroughly cleansed by way of spray pipe 72 (FIG. 4), disposed along its axis. Typically, the dye liquor is reestablished by applying a control programme to the solenoid valves which triggers the valve in step by step fashion. This programme can also be used at any time to test run the circuit to ensure that all lines are open and free of air pockets.

The dye pressure in pressure column 40 is chosen, having regard to the characteristics of the particular dye being employed, to the length of the flow tubes 50, 54,56 and to the size of the nozzle orifices to afford stream rates of flow sufficient to properly and uniformly pattern the carpet without undue soaking and colour zone overflow.

Figure 5:
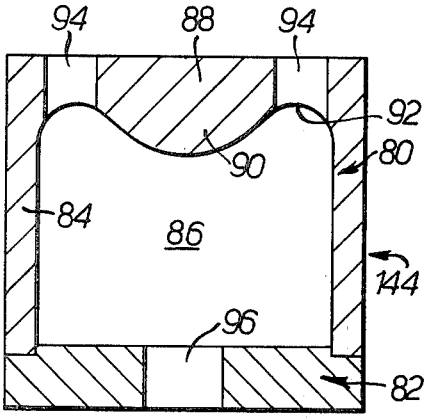
FIGS. 5 and 6 are respectively an axial cross-section and a plan view of a simple distributor in accordance with the invention.
Figure 6:
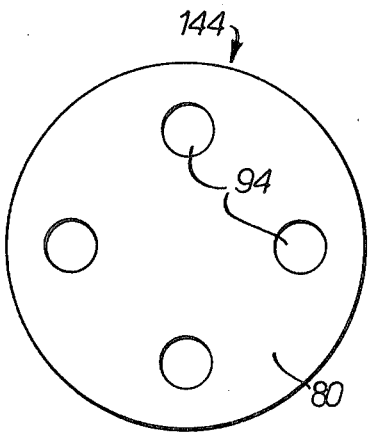

It is found that by incorporating a distributor in association with a reduced number of electronically programme controlled valves, a very satisfactory consistent printed carpet produced can be obtained entailing appreciably less machine down time. Optimum operation of the illustrated unit, especially in regard to pattern reliability, is achieved, inter alia, by careful design of the distributors 44 and nozzles 24. In particular, the distributors should entrap air when liquid is initially permeated through the flow circuitry. Such air pockets may subsequently break the desired capillary action and introduce a dye application fault. FIGS. 5 and 6 depict a simple form of distributor 144 which is preferred where variation of print width is not of concern.

Distributor 144 is of two-part construction comprising a cup-shaped part 80 and a cover part 82. Cup shaped part 80 has a relatively thin cylindrical wall 84 bounding a holding cavity 86. A base wall 88 defines a central axially symmetrical domed portion 90 surrounded by an annular channel 92 of smoothly concave uniform cross-section.

The concave surface of channel 92 is contiguous at its outer periphery with the inner face of wall 84.

It is from channel 92 that the required outlet ports 94 open. Ports 94 are evenly spaced about the channel in circumferential array; four are depicted in FIG. 2 but this design feature is merely for purposes of illustration and specific application to the dye applicator unit of FIGS. 1 to 4.

Cup shaped part 80 is closed by cover part 82 which is grooved at its periphery to seat on the lip of the cup shaped part and bored at its center to provide an inlet port 96 to cavity 86.

An important advantage of using distributors in association with programmed flow valves to create a discrete number of repeat pattern sections across the carpet is that varying standard widths of carpet may be readily printed. For example, the carpet width may be reduced, say from 12 to 9 ft by making use of modified distributors in which selected outlet ports can be closed off. FIGS. 7 to 11 detail an array of distributors structured and interengaged to achieve this facility.

Figure 7:
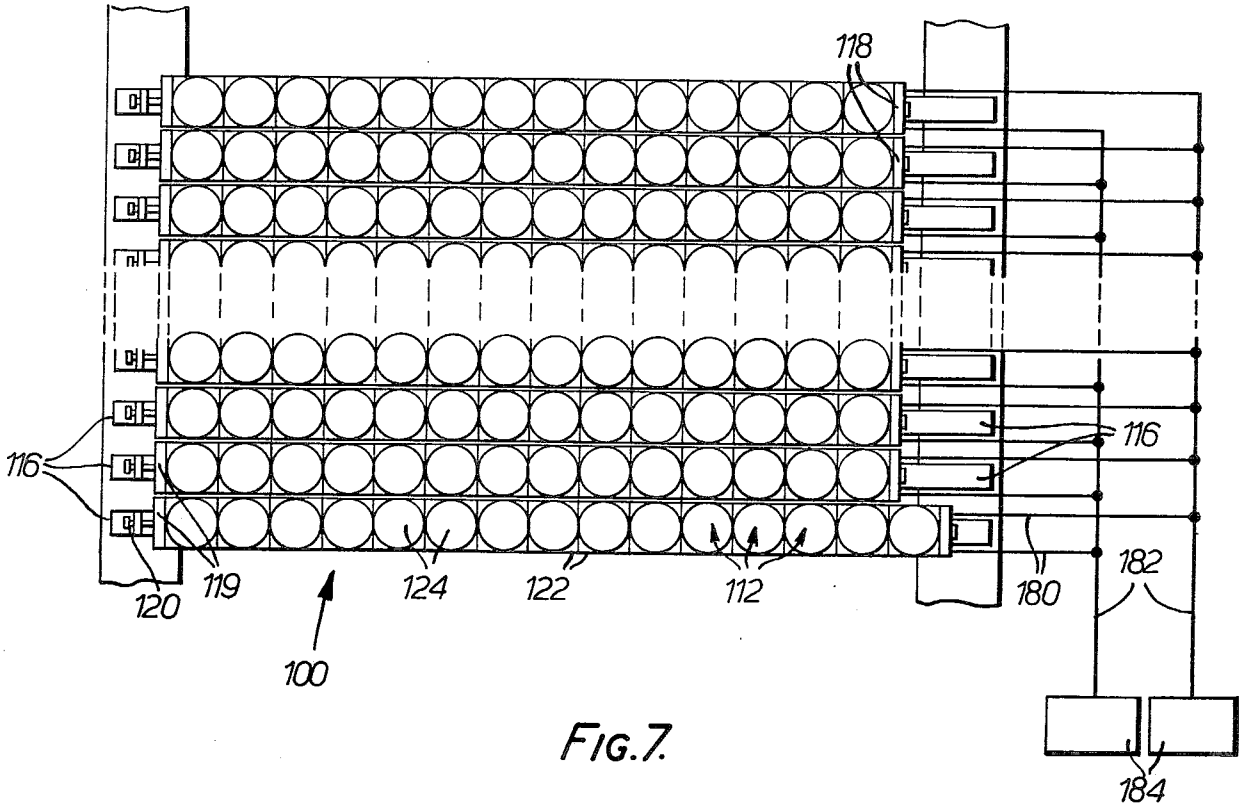
FIG. 7 is a plan view of a distributor assembly which may form part of the unit of FIGS. 1 to 4.
Figure 8:
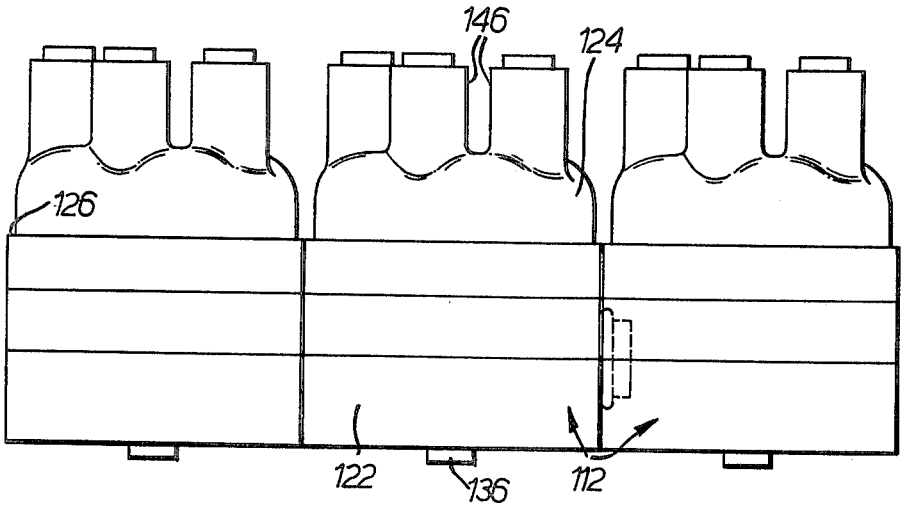
FIG. 8 is a partial side elevation on the line 8—8 in FIG. 7 showing three abutting fluid distributors.

FIG. 7 depicts in plan a typical distributor assembly 100 which might suitably form the array 42 mounted atop the applicator unit of FIGS. 1 to 4. The assembly is supported on a horizontal distributor board and, in the present example, consists of 336 distributors 112 each having a maximum output of 5 streams for one inlet stream.

The distributors are square based and arranged in linear array in abutting relationship. More particularly, they are interlocked together, by means discussed subsequently, in a multiplicity of side by side rows 114. Each row 114 is clamped on a supporting strap 116 by end brackets 118,119. Bracket 118 is welded to strap 116 while the position of bracket 119 is slightly adjustable by a screw clamping assembly 120 which may be withdrawn sufficiently to allow disengagement of at least one distributor coupling.

Each fluid distributor 112 of assembly 100 is formed from two parts, a lower, generally rectilinear base 122, square in plan, and an upper, essentially circular dome 124. Both parts may be moulded in a suitable plastics material such as polyvinyl chloride and may be fastened together by way of an appropriate solvent cement. The dome 124 has an open bottom bounded by an annular rim 128 which sits tightly within a matching annular lip 126 on the top surface of base 122. Correct relative positioning of the parts is assured by a location pin 130 on rim 128 and a matching recess adjacent lip 126.

The space 132 defined within dome 124 above the top surface of base 122 constitutes a distribution or holding cavity. The intake port to the cavity is provided by a duct 134 which passes centrally vertically through the base 122 from a connector assembly 136 on the underside of the base. In situ, connector assembly 136 receive a flexible tube for supplying dye liquor from the relative dye flow control valve.

As already indicated, there are five outlet ports. These are indicated at **138,138*a* and it will be seen, from an inspection of FIGS. 9 and 10 in particular, that outlet ports 138,138*a* open at equi-circumferentially spaced intervals from a shallow channel 140 defined at the top of dome 124 by a central located depressed portion 142. Each outlet port 138, 138*a* communicates with a connector assembly 144 within a respective funnel-like protrusion 146** for attachment to a flexible tube by which dye may be lead to a relative nozzle at the nozzle array.

Three of the outlet ports 138 are permanently open to cavity 132, while two, **138*a*, may be individually selectively closed by means of mechanism now described with special reference to FIG. 10. The two closable outlet ports are arranged at equally distant extremities to either side of a plane passing centrally through the base 122 parallel to one pair of opposite side thereof. Extending coaxially under each of these nozzles 138*a* is a solid plunger 150 which extends through a vertical bore 152 in base 122 and across a respective horizontal bore 154 passed wholly through the base on an axis parallel to the aforesaid plane. The lower end of bore 152 is closed by a plug 156**.

Plunger 150 is biased downwardly against plug 156, the open position, by a helical compression spring 158 which acts between shoulders afforded by a head disc 160 on plunger 150 and the bottom of the counter bore 162 to bore 152. In this position of the plunger, disc 160 is kept spaced from plug 156 by a central pin 164 and is laterally loose within counter bore 162 so as to allow fluid to readily flow around its outer periphery into the space 163 between disc 160 and plug 156. It will now be seen that if sufficient fluid pressure is developed in bore 154, the force applied to the underside of the disc 160 will overcome the biasing force of spring 158 to push plunger 150 upwardly into contact with an annular seat 166 about the respective outlet port **138*a*. To achieve a sealing engagement, the upper end of plunger 150 carries a suitable resilient insert 168, while ingress of fluid from bore 154 to cavity 132 is prevented by an 'O' ring 178 on plunger 150**.

The two bores 154 extend at one side of the distributor base into a spigot element 172 which protrudes from the base and carries an outer 'O' ring 174. The other end of bore 154 is counterbored at 176 to sealingly receive, in a complementary manner, the spigot of an adjacent distributor. It will now be seen, reverting to FIG. 7 and referring also to FIG. 8, that each row 114 of distributors is coupled together by engaging the spigots 172 of each distributor into the matching counterbores 176 of the next distributor. In this way, not only are the distributors locked together on the mounting strips 116, but two continuous fluid ducts are defined over the whole length of each row. At one end of the rows, these ducts are communicated through apertures in brackets 118 and by tubes 180 to respective leader ducts or manifolds 182 which are in turn coupled to individual valves 184.

By using the valves 184 to apply a predetermined fluid pressure via manifolds 182, tubes 180 and bores 154 to the underside of the plunger discs 160, all of the plungers extending into the respective bores 54 of each row may be swiftly and reliably raised to close off the relative outlet ports **138*a* in the distributors. Assuming that the nozzle board of the dye applicator unit is divided into five sections of nozzles in linear succession and that the nozzles of each section are connected to the outlet ports at a particular location on the distributors with respect to the major axis of the array shown in FIG. 7, the arrangement thereby affords a very compact and effective manner of varying the number of nozzle board sections in use. By way of example, if the maximum printable carpet width is 450 cm, by connecting the two sets of controllable outlets 138*a*** to the outside nozzle sections, conversion of the machine to printing 360 and 270 cm widths can be readily effected.

An alternative approach to varying the dyed carpet width is to provide latterally insertable trays to collect dye liquor from an outside nozzle section or part section before it contacts the carpet. Spatial considerations may render this difficult (it is desirable that the nozzle orifices be only a short distance above the carpet in the printing mode), and it may thus be preferable to render parts of the nozzle board detachable from removal to the side to be placed over fixed "spare" trays. A still further alternative is to provide a 3-way valve in the feed tubes leading to the nozzles of a specific nozzle section to allow bypass of the liquor to a side collection trough, or of a coupling board which is physically adjustable to selectively connect distributor outlet lines to nozzle inlet lines or to bypass lines.

Attention is now directed to the exact form of each nozzle 24. It has been found that reliability of the described dye applicator unit, particularly as regards uniformity of the patterns produced from one application to another and as between the nozzles controlled through a given distributor, is detrimentally affected by the formation of drips at the orifices of the dye emitting nozzles while dye liquor is retained in the nozzles by capillary action. With conventional nozzles, such drips can be quite large and may give rise to local excess dye application areas in the carpet pattern. With these potential problems in mind, the nozzles 24 are preferably of the form shown in FIG. 12. Each nozzle 24 is axially symmetrical and includes a cylindrical body 200. A bore 212 extends from a convergent intake end 214 of the nozzle to a point relatively close to the opposite end 216 through which an outlet orifice 218 opens from bore 212. Orifice 218 is of somewhat reduced diameter relative to the bore so as to define a slanted annular shoulder 220 at the transit between the two. The external edge 218*a* of orifice 218 is chamfered and, further, is surrounded by a flat annular end face 222 of the nozzle body 200. End faces 222 lines in a plane at right angles to the axis of body 200 and is of substantial radial extent relative to the diameter of the orifice.

It is found that the presence of the flat annular end face about the outlet orifice and the provision of a supply bore occupying most of the length of the nozzle body but relative to which the orifice affords a restriction to flow, are important in reducing meniscus expansion and consequent drip formation at the exterior of the orifice. Emperical evidence suggests that it is the lengths of the nozzle and of the bore supplying the orifice which have greater effect on drip formation, rather than the actual volume of liquor retained therein.

Clearly, optimum relative and absolute dimensions for a nozzle in accordance with the invention will be dependent upon physical properties, such as viscosity, of the fluid to be applied to the nozzle. In the case where inventive nozzles are to be employed in the above-described carpet-printing processes as applicator nozzles for directing dye liquor streams at an underlying web of carpet, an exemplary nozzle for ⅛th inch (3.18 mm) pattern line spacing has an outside diameter of 0.187 inches (4.75 mm) and a length of 0.625 inches (15.89 mm). The bore 212 is 0.0625 inches (1.59 mm) diameter to within 0.0625 inches (1.59 mm) of the face 222 and the orifice 18 is 0.040 inches (1.02 mm) in diameter. Generally, it is preferred that the diameter of the nozzle be about two-thirds the diameter of the bore and that the length of the bore be about eight to ten times its diameter.

Reverting to the description associated with FIGS. 7 to 11, return of plunger 150 is shown as being effected by spring 158. Instead, a second bore similar to but below bore 154 might be provided for pneumatically returning the plunger. Such bores could be coupled distributor-to-distributor after the matter of bores 154.

We claim:

1. Apparatus for applying liquid to a strip, comprising: a liquid application station; conveyor means for guiding said strip past the application station; means for providing a reservoir of the liquid; an array of multiple openings arranged above and transversely of the conveyor means at said application station; and, disposed in fluid flow lines between the reservoir means and said openings, multiple remote controllable valve means selectively actuable by a programmable electronic control to cause respective streams of liquid when received from said reservoir to issue from the openings onto said strip at the application station in accordance with a predetermined pattern of application of the liquid to the strip; wherein there is further provided a multiplicity of fluid distributors arranged in said fluid flow lines between the valve means and said openings so that each distributor is coupled to one valve means and to a respective group of associated spaced openings of said array, the groups of openings being so arranged in relation to one another that one or more repeats of said pattern occur across said strip; and wherein the fluid lines connecting the openings of each group to its distributor are of substantially equal length.

2. Apparatus according to claim 1 wherein each distributor has a holding cavity, an inlet port to said holding cavity and a plurality of outlet ports from the cavity, the outlet ports being substantially opposed to the inlet ports and being formed in wall portions which are concave to said cavity.

3. Apparatus according to claim 2 wherein said cavity is defined in part by a cylindrical wall and the outlet ports are spaced about an annular channel which forms an extension of the cavity and is determined by a surface smoothly and continuously curved transversely of the channel.

4. Apparatus according to claim 1, 2 or 3 wherein each distributor includes means for selectively closing off a corresponding outlet port thereof whereby to reduce the width of said strip to which liquid is applied.

5. Apparatus according to claim 1 wherein each fluid distributor comprises:

a body;

an inlet port to a holding cavity within the body, and a plurality of outlet ports from the cavity; and plunger means actuable to close off one of the outlet ports;

wherein the plunger means extends into a control fluid duct passing through the distributor body and is arranged to be actuable as aforesaid by a predetermined fluid pressure in the duct.

6. Apparatus according to claim 5 wherein the fluid distributors are so arranged that their control fluid ducts are connected in series.

7. Apparatus according to claim 6 wherein the distributor bodies are arranged in linear array in abutting relationship with the said fluid flow duct of each distributor body communicating directly with the duct of the adjacent body or bodies.

8. Apparatus according to claim 1, 2, 3, 5, 6 or 7 wherein said openings comprise nozzles or orifices coupled to said fluid distributors by individual flexible tubes, the tubes associated with each distributor being of equal length.

9. Apparatus according to claim 8 wherein each nozzle is of elongated form and has a smooth bore extending from one end of the nozzle almost to the other end, an orifice of smaller diameter than the bore, which orifice opens from the bore through said other end of the nozzle, and an external annular end face about said orifice, which face lies in a plane at right angles to the elongate dimension of the nozzle and is of substantial radial extent relative to the diameter of the orifice.

10. Apparatus according to claim 9 wherein the diameter of the nozzle is about two-thirds the diameter of the bore so as to define an appreciable annular shoulder at the boundary between the two.

11. Apparatus according to claim 1, 2, 3, 5, 6 or 7 wherein each valve means is of a type remotely actuable by electronic or pneumatic means.

* * * * *